US005830379A

United States Patent [19]

Tunzi

[11] Patent Number: 5,830,379

[45] Date of Patent: Nov. 3, 1998

[54] STACKABLE ICE TRAY AND BIN ASSEMBLY

[75] Inventor: Todd J. Tunzi, Newton, Iowa

[73] Assignee: Maytag Corporation, Newton, Iowa

[21] Appl. No.: 869,251

[22] Filed: Jun. 4, 1997

[51] Int. Cl.[6] ..... B28B 7/024

[52] U.S. Cl. ..... 249/126; 249/130; 249/203; 62/344

[58] Field of Search ..... 249/126, 119, 249/130, 120, 203, 121; 62/344; 206/511

[56] References Cited

U.S. PATENT DOCUMENTS

| | | | |
|---|---|---|---|
| 1,807,587 | 6/1931 | Copeman | 249/127 |
| 2,587,852 | 3/1952 | Jahn et al. | 249/130 |
| 3,352,528 | 11/1967 | Berstrom et al. | 249/120 |
| 4,366,941 | 1/1983 | Harris | 249/126 |
| 4,372,526 | 2/1983 | Daenen et al. | 249/126 |
| 5,190,156 | 3/1993 | Conaway et al. | 206/511 |
| 5,344,022 | 9/1994 | Stahl | 206/511 |

*Primary Examiner*—Jay H. Woo
*Assistant Examiner*—Robert Hopkins
*Attorney, Agent, or Firm*—Everett G. Diederiks, Jr.

[57] ABSTRACT

A stackable ice tray and bin assembly includes an ice cube forming tray having an annular outer rim with an associated upper ledge, as well as a matrix of ice cube defining cavities arranged within the confines of the annular outer rim. Each of the cavities is defined by a base and upstanding side walls, with the side walls of adjacent cavities being formed with a generally V-shaped passage that fluidly interconnects the adjacent cavities. Positioned within the passage is a dam member over which fluid from one cavity must flow to reach the adjacent cavity. The bottom of the tray is formed with a plurality of seating units, each of which includes inner and outer shift limiting elements and an abutment member. The seating units enable the tray to be stacked upon an identically constructed, lower tray with the abutment member of the upper tray resting upon the upper ledge of the lower tray and the inner and outer shift limiting elements extending about the annular outer rim of the lower tray. The bin incorporated in the present invention includes similarly constructed seating units which enable the bin to be stacked atop one or more of the identically constructed trays wherein easy access to a storage area defined by the bin is provided.

19 Claims, 4 Drawing Sheets

STACKABLE ICE TRAY AND BIN ASSEMBLY

BACKGROUND OF THE INVENTION

1. Field of the Invention

The present invention pertains to the art of refrigerators and, more particularly, to a tray for forming, as well as a bin for storing, ice cubes in a freezer compartment of a refrigerator.

2. Discussion of the Prior Art

Many household refrigerators available on the market today incorporate automatic ice cube makers. The refrigerator models that do not have automatic ice makers are generally provided with subdivided trays which can be filled with water and then placed in the freezer compartment of the refrigerator in order to produce ice cubes for use in serving beverages. Such ice trays are generally rectangular in shape and therefore have associated front and back dimensions which are substantially shorter than side dimensions thereof. The ice trays are integrally molded of plastic and formed with an annular rim portion within which is defined a plurality of interconnected ice cube forming cavities, with adjacent cavities having common side walls. In order to form ice cubes, the cavities are filled essentially on an individual basis with any overflow above the side walls of one cavity being delivered into an adjacent cavity. The main problem with this arrangement is that it results in uneven filling of the cavities and therefore results in the production of varying sized ice cubes. When filling the trays with water, one can attempt to even out the height of the water by slightly rotating the tray in order to redirect the flow of water, but this can result in actual spillage of the water outside the tray.

Typically, the ice cube trays can be stacked upon each other and further upon a bin used for storing the formed ice cubes. Typically, various ice cube trays would be filled with water and then stacked upon the bin and each other. When the ice cubes in those trays are formed, the cubes would be transferred into the bin and the trays would be refilled and again stacked upon the bin for making additional cubes. Ideally, the rate at which the cubes are moved from the bin generally corresponds to the rate at which the new ice cubes can be formed in the trays such that when the ice cubes in the bin are depleted, the new cubes have been formed and then can be again emptied into the bin. Such a bin is almost invariably provided with a lower front opening for accessing the ice cubes placed therein while still enabling the trays to remain stacked upon the bin.

Various additional problems are developed by such an arrangement. First of all, since the ice trays are stacked upon the bin, only a limited access area to the ice cubes in the bin can be provided. This problem becomes particularly apparent when the front portion of the bin is depleted of ice cubes and the ice cubes in the rear of the bin must be accessed. Oftentimes, the access opening is not large enough to fully accommodate the hand of an adult. Even if one can reach the back of the bin, it is often difficult to remove the cubes without shifting of the entire bin and tray assembly. If the trays have been recently filled with water, such shifting can result in spillage of water into the freezer compartment of the refrigerator. In addition, since the ice cube trays are stacked upon the bin, the bin cannot be readily removed from the freezer compartment by itself.

Although various solutions have been proposed in the past in an attempt to address these and other problems associated with prior art ice cube tray and bin assemblies, problems still exist in this art. Therefore, there exists a need for an improved stackable ice tray and bin assembly.

SUMMARY OF THE INVENTION

The present invention is particularly directed to a tray for forming, as well as a bin for storing, ice cubes in a freezer compartment of a refrigerator. The tray is provided with a matrix of ice cube forming cavities which are particularly designed to enhance liquid communication therebetween such that uniformly-shaped ice cubes can be produced while still enabling the cubes to be readily removed from the tray when completely formed. The outermost portion or shell of the tray also incorporates structure which enables the tray to be readily stacked upon an identically formed tray, with the trays being limited from shifting relative to each other. The bin for storing the trays is formed with similar structure at the bottom thereof which enables the bin to be stacked atop the trays.

More specifically, the ice cube forming tray includes an annular outer rim that has an associated upper ledge, as well as a matrix of ice cube defining cavities arranged within the confines of the annular outer rim. Each of the cavities is preferably defined by a generally inverted, conical base from which project upwardly and outwardly extending side wall portions, with adjacent side wall portions having a common upper edge that is arranged in a plane below the upper ledge of the annular outer rim. Each of the side walls between adjacent cavities is formed with a generally V-shaped passage that fluidly interconnects the adjacent cavities. Within the passage is provided a dam member over which fluid from one cavity must flow to reach the adjacent cavity. The passages preferably extend for approximately a third of the length of the side walls to enable adequate fluid communication between the cavities and to assure that the cavities will be substantially, evenly filled.

The bottom of the tray is also formed with a plurality of seating units, each of which includes inner and outer shift limiting elements and an abutment member. In the preferred embodiment, the seating units are arranged at corner portions of the tray and the abutment member interconnects the inner and outer shift limiting elements. Both the inner and other shift limiting elements are preferably arranged in a plane that is commensurate with the plane of a bottom surface of the base of the cavities such that, when the tray is placed on a generally horizontal surface, the tray is supported by both the lowermost portions of the seating units and the bottom surfaces of the cavity bases. The inclusion of the seating units enables the tray to be readily stacked upon an identically constructed tray with the abutment member of the tray resting upon the annular outer rim of the identically constructed tray positioned therebelow and with the inner and outer shift limiting elements extending about the annular outer rim of the identically constructed tray.

The ice cube storing bin in accordance with the present invention includes integrally formed bottom, front, rear and side walls, with the front, rear and side walls extending upwardly from outer peripheral portions of the bottom wall. The bin is further provided with a plurality of bin seating units formed at a lower side surface of the bottom wall. In a manner analogous to the seating units of the tray, the bin seating units also preferably include inner and outer shift limiting elements which are interconnected by an abutment member. The lowermost portions of the inner and outer shift limiting elements are adapted to directly engage and support the bin when the bin is placed on a planar surface. On the other hand, the seating units enable the bin to be placed atop one or more of the identically constructed trays with the abutment members of the bin seating units resting upon the annular outer rim of the uppermost tray and the inner and outer shift limiting elements of the bin seating units extending about the annular outer rim of the tray to limit relative shifting therebetween.

Since the bin is supported upon one or more ice trays in accordance with the present invention, easy access to ice placed within the bin is available. In addition, the bin can be readily removed from atop the ice tray(s) without disturbing the positioning of the ice tray(s). The construction of each ice tray clearly enhances the ability to produce uniformly shaped ice cubes and also enables the tray to be supported upon a horizontal surface in an effective force distributing manner. In addition, the annular outer rim and seating units of each tray are specifically designed to interact to thereby enable stacking of identically constructed trays, while restricting relative shifting movement therebetween.

Additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
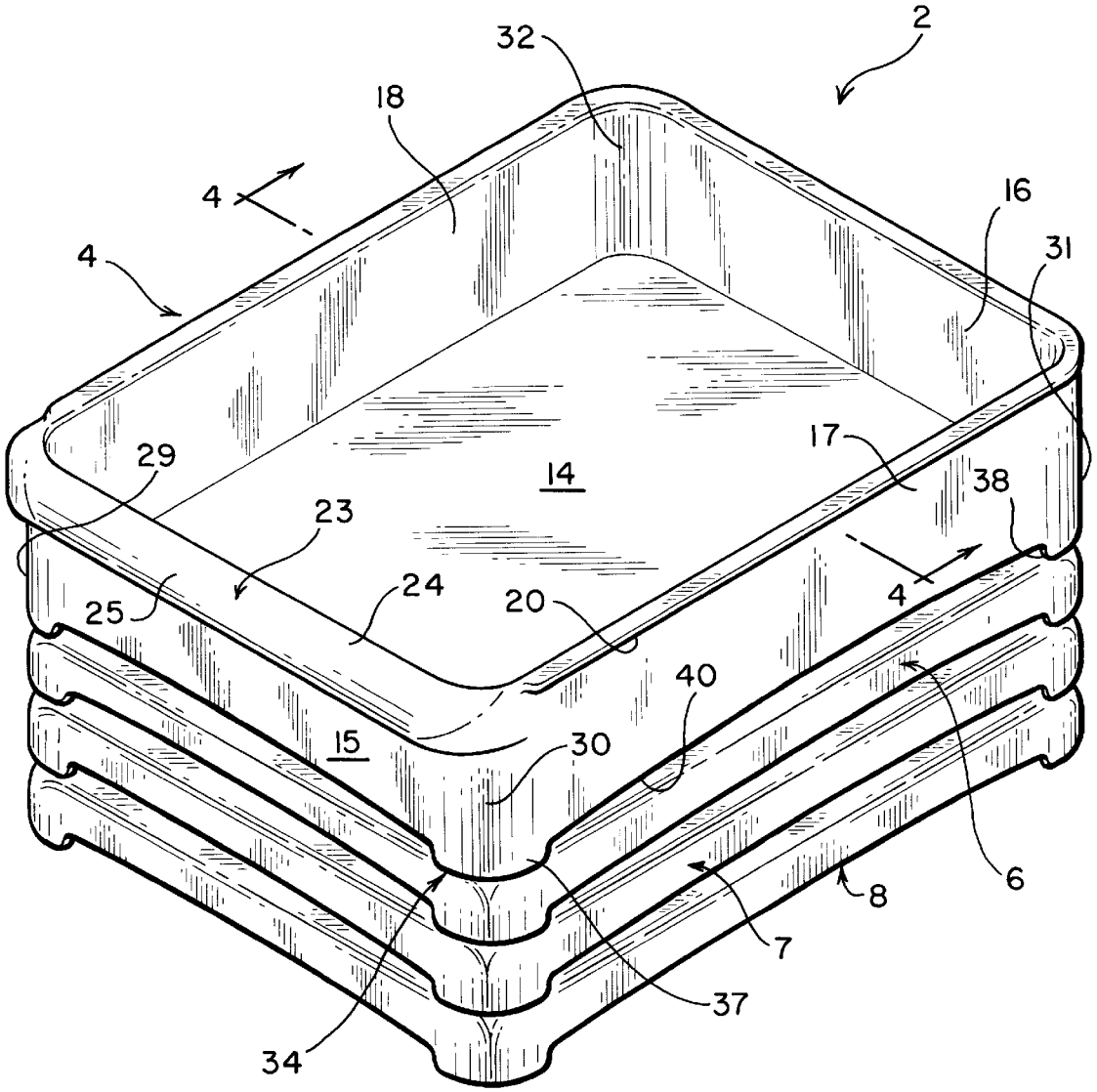
FIG. 1 is a perspective view of a stackable ice tray and bin assembly constructed in accordance with the present invention.

As depicted in these drawings, the stackable ice tray and bin assembly of the present invention is generally indicated at 2. Tray and bin assembly 2 includes an ice storing bin 4 and one or more ice trays 6–8. In accordance with the preferred embodiment, both bin 4 and trays 6–8 are injection molded of plastic and, as clearly illustrated in these figures, are adapted to be vertically stacked with each ice tray 6–8 being identically constructed so as to be stackable one upon the other and with bin 4 being stackable upon one or more of the ice trays 6–8.

In accordance with the preferred embodiment, bin 4 is provided with bottom, front, rear and side walls 14–18, with front, rear and side walls 15–18 extending upwardly from respective outer peripheral portions of bottom wall 14. The upper edge of rear and side walls 16–18 defines an outturned flange 20. Front wall 15 is provided, at a location spaced from bottom wall 14, with a handle 23 having an upper portion 24 and a down-turned portion 25 that merges with side walls 17 and 18. With this construction, handle 23 defines an elongated recess 26 within which fingers of a user of the tray and bin assembly 2 can be positioned for lifting, carrying and/or shifting of bin 4.

Figure 3:
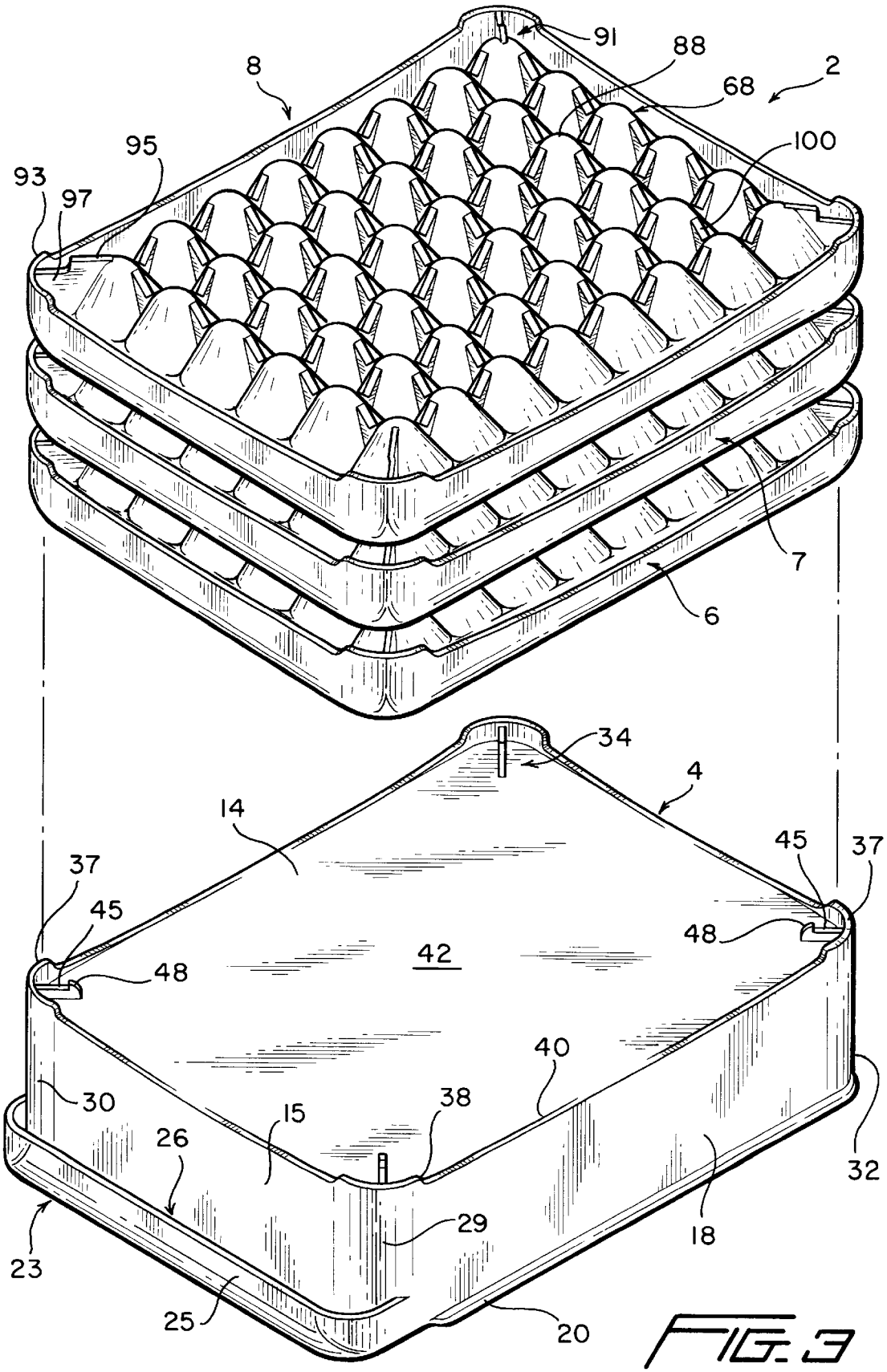
FIG. 3 is an exploded, lower perspective view of the stackable ice tray and bin assembly of FIG. 1.

In the preferred embodiment, front and rear walls 15 and 16 have associated dimensions which are only slightly less than that of side walls 17 and 18. Actually, in the preferred embodiment, front and rear walls 15 and 16 are approximately 8½ inches long (21.6 cm) and side walls 17 and 18 are in the order of 11½ inches long (29.2 cm). Of course, these dimensions are only presented for the sake of completeness and can vary within the scope of the present invention. However, in accordance with the invention, bin 4 is preferably polygonal-shaped and therefore includes corner portions 29–32 at the junctures of front and rear walls 15 and 16 with side walls 17 and 18. As perhaps best shown in FIGS. 3 and 4, each corner portion 29–32 is provided with a bin seating unit which is generally indicated at 34. Each seating unit 34 is preferably identically 15 constructed as best shown in FIGS. 3 and 4 and detailed below.

In accordance with the preferred embodiment, each bin seating unit 34 includes an outer shift limiting element 37 which is generally defined by an extension of a respective corner portion 29–32. Therefore, outer shift limiting element 37 of each bin seating unit 34 is actually formed by extending respective portions of front, rear and side walls 15–18. Each outer shift limiting element 37 includes an outer sloping portion 38 that leads to a tapering reinforcing flange 40 that slopes towards bottom wall 14. In the preferred embodiment, each tapering reinforcing flange 40 reaches the plane of bottom wall 14, as defined by lower side surface 42 thereof, at a position spaced intermediate of the respective front, rear and side walls 15–18. With this construction, the lower edges of front, rear and side walls 15–18 have a very aesthetically attractive arcuate configuration while, at the same time, function to structurally reinforce each outer shift limiting element 37. Each bin seating unit 34 further includes an abutment member 45 that is connected to the outer shift limiting element 37 and preferably projects along a radius for a respective one of the corner portions 29–32. Spaced inwardly of each outer shift limiting element 37 is an inner shift limiting element 48 which, in the preferred embodiment, is formed integral with abutment member 45 and projects below the level of abutment member 45. Actually, inner shift limiting element 48 preferably terminates in a plane commensurate with the lower edge of outer shift limiting element 37 such that bin 4, when placed upon a horizontal planar surface, is supported by each of the outer and inner shift limiting elements 37 and 48. Before describing the manner in which bin seating units 34 enable bin 4 to be stacked atop ice trays 6–8, the preferred construction of ice trays 6–8 will be detailed.

First of all, it should be noted that ice trays 6–8 are preferably identically constructed and therefore the particular order in which the trays 6–8 are stacked is irrelevant. In addition, this enables bin 4 to be stacked directly atop any one of trays 6–8 . It should also be noted that the particular number of trays utilized in connection with the stackable ice tray and bin assembly 2 of the present invention can vary.

Figure 2:
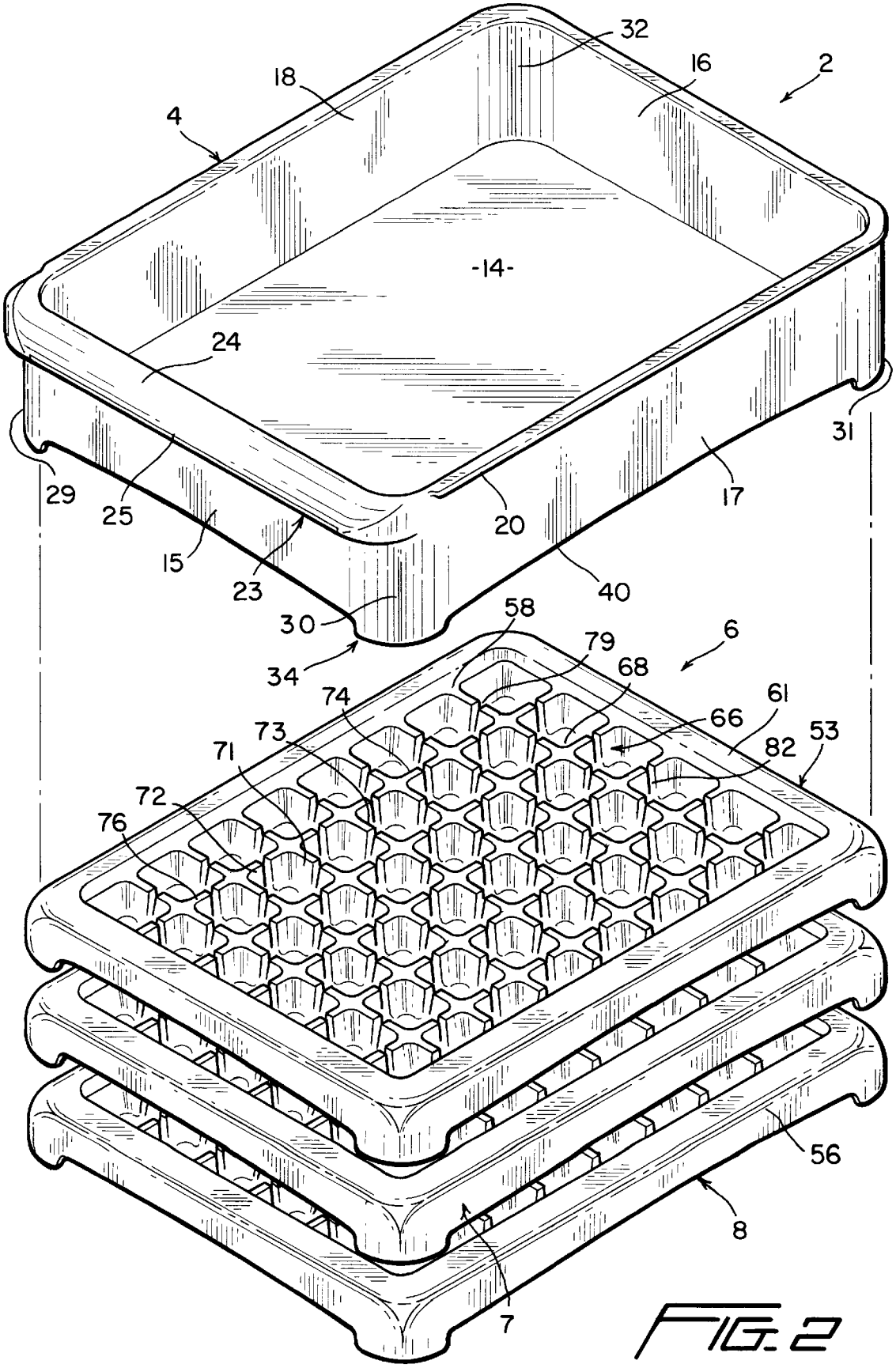
FIG. 2 is an exploded, upper perspective view of the stackable ice tray and bin assembly of FIG. 1.
Figure 4:
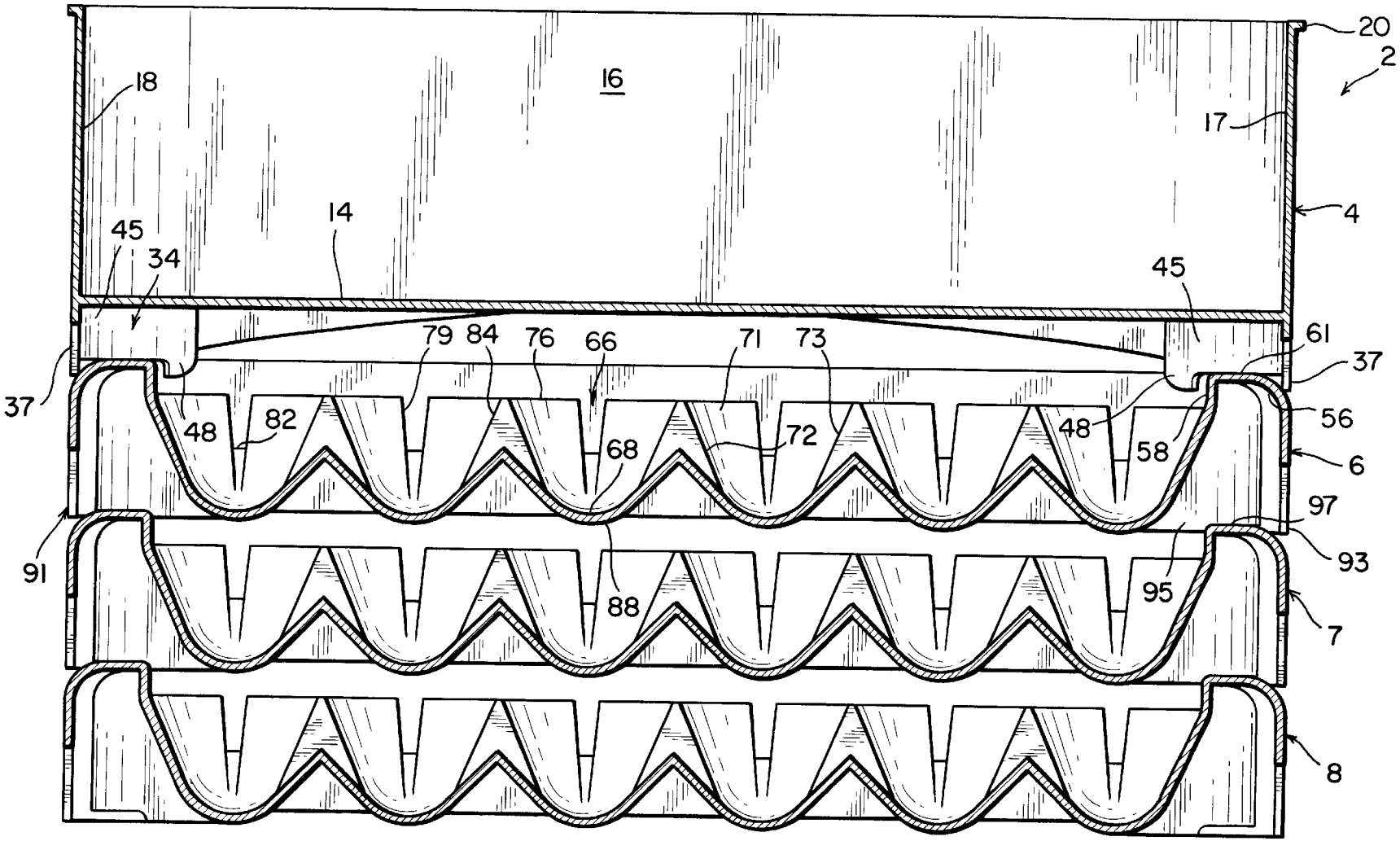
FIG. 4 is a cross-sectional view of the stackable ice tray and bin assembly of the present invention generally taken along 4—4 of FIG. 1.

As shown best in FIGS. 2 and 4, each ice tray 6–8 includes an annular outer rim 53 defined by integrally formed first and second opposing side rim members 56 and 58 and an upper ledge 61. Located within the confines of first and second opposing side rim members 56 and 58 is a matrix of ice cube defining cavities 66. Each cavity 66 of the matrix includes a base 68, that preferably is inversely conical in shape, and plural side walls 71–74 that extend upwardly from base 68. Actually, each of the side walls 71–74 preferably slopes upwardly and outwardly from base 68. The side walls 71–74 of adjacent cavities 66 have a common upper edge 76. Although base 68 is arcuate and side walls 71–74 slope upwardly and outwardly, the upper edges 76 of each cavity 66 are generally arranged in a square pattern as best shown in FIG. 2.

Each of the side walls 71–74, which are located inwardly from the first and second opposing side rim members 56, 58, is formed with a generally V-shaped passage 79 within which is positioned a dam member 82. With this construction, each passage 79 exhibits a generally inverted V-shape in cross-sectional view as clearly shown in FIG. 4. In the preferred embodiment, each passage 79, even given the presence of dam member 82, extends downward from upper edge 76 of a respective side wall 71–74 a distance in the order of a third of the height of side walls 71–74. With this arrangement, cavities 66 are placed in fluid communication with each other such that when the tray is filled with water through a spigot or the like which directs the flow of water in a concentrated zone of the matrix, the water will be permitted to readily flow between the various cavities 66 such that the water comes to rest in each cavity 66 at generally the same height, which is above dam member 82. Of course, the cubes that will be formed in each of the cavities 66 will therefore be interconnected by ice formations within passages 79. However, since each passage 79 extends downward only through a percentage of side walls 71–74 and dam members 82 wedge directly below the formation of ice in the passages 79, it has been found that the ice cubes formed utilizing trays 6–8 can be readily released from cavities 66.

As shown in FIGS. 3 and 4, the base 68 of each cavity 66 has a lower surface 88 extending in a common plane. Each ice cube tray 6–8 is also formed with respective tray seating units 91 that are also arranged at corner portions (not separately labeled) of the trays 6–8 . In a manner analogous to the bin seating units 34, each tray seating unit 91 includes an outer shift limiting element 93 that projects downward from a respective side rim members 56, an inner shift limiting element 95 and an abutment member 97. Since trays 6–8 are preferably injection molded of plastic, each of the inner shift limiting elements 95 is actually made integral with portions of the base 68 and a respective side wall 71–74 of a cavity 66 located at a corner of the matrix. In fact, as clearly illustrated in FIG. 4, inner shift limiting element 95 has a lowermost edge (not separately labeled) that is arranged in the same plane as the lower surfaces 88 of bases 68. The same is true for outer shift limiting elements 93 such that, when any of the ice trays 6–8 are placed upon a planar horizontal surface, the ice trays 6–8 are supported by the lower surfaces 88 of bases 68, as well as the lowermost edges of outer and inner shift limiting elements 93 and 95. For added structural integrity, the side walls 71–74 of adjacent cavities 66 are interconnected by reinforcing members 100 which are generally V-shaped as shown in FIG. 3.

With this construction, ice trays 6–8 can be stackably supported upon each other while any lateral shifting therebetween is limited. More specifically, with reference to the manner in which ice tray 6 is stacked upon ice tray 7 as clearly shown in FIGS. 1 and 4, each abutment member 97 of ice tray 6 will rest upon an upper ledge 61 of ice tray 7 such that ice tray 6 is supported upon ice tray 7 at the corners thereof. In addition, outer and inner shift limiting elements 93 and 95 extend along respective ones of the first and second opposing side rim members 56 and 58 in order to limit the lateral movement between trays 6 and 7. In a similar manner, bin 4 can be stacked upon trays 6–8. In the arrangement shown in FIG. 4, abutment member 45 of each bin seating unit 34 rests upon upper ledge 61 of ice tray 6 and outer and inner shift limiting elements 93 and 95 extend along the first and second opposing side rim members 56 and 58 respectively, in order to limit shifting between bin 4 and ice tray 6.

With this arrangement, it should be apparent that bin 4 can be readily removed from atop ice trays 6–8 and access to any ice cubes placed within bin 4 is enhanced over typical tray and ice bin assemblies. In addition, the particular construction of each of the ice trays 6–8 provides for effective stacking thereof, while avoiding the need for precision molding of the ice trays 6–8 since some limited lateral shifting therebetween is permitted given the design of tray seating units 91. The same is true with respect to the design of bin seating units 34. However, although described with respect to a preferred embodiment of the invention, it should be readily understood that various changes and/or modifications can be made to the particular construction of bin 4 and ice trays 6–8 without departing from the spirit of the invention. In general, the invention is only intended to be limited by the scope of the following claims.

I claim:

1. A combination tray and bin assembly adapted for use in forming and storing ice cubes in a freezer compartment of a refrigerator comprising:

an ice cube forming tray including an annular outer rim portion, defined by integrally formed first and second opposing side rim members and an upper ledge, and a matrix of ice cube defining cavities arranged within confines of the annular outer rim portion, each of the cavities including a base from which project upwardly extending side wall portions with adjacent ones of the side wall portions having a common upper edge that is arranged in a plane below the upper ledge of the annular outer rim portion; and an ice cube storing bin including integrally formed bottom, front, rear and side walls with the front, rear and side walls extending upwardly from outer peripheral portions of the bottom wall, the bin further including a plurality of bin seating units formed at a lower side surface of the bottom wall, each of the bin seating units being adapted to rest upon a respective section of the upper ledge of the tray such that the tray and bin nest with the bin being directly supported atop the tray.

2. The combination tray and bin assembly according to claim 1, wherein each of the bin seating units includes a shift limiting element and an abutment member, wherein the abutment member is adapted to rest upon the respective section of the upper ledge of the tray, with the shift limiting element extending along one of the opposing side rim members when the bin is seated upon the tray.

3. The combination tray and bin assembly according to claim 2, wherein each of the bin seating units includes inner and outer shift limiting elements which are adapted to extend along the first and second side rim members respectively.

4. The combination tray and bin assembly according to claim 3, wherein the abutment member extends between and interconnects the inner and outer shift limiting elements of a respective bin seating unit.

5. The combination tray and bin assembly according to claim 4, wherein the bin is polygon-shaped and includes multiple corner portions, with the outer shift limiting elements being constituted by arcuate, downward extensions of the corner portions.

6. The combination tray and bin assembly according to claim 5, wherein each of the corner portions includes respective outer portions which are further interconnected to the bottom wall of the bin by elongated, tapering reinforcing flanges that define lowermost portions of the front, rear and side walls of the bin.

7. The combination tray and bin assembly according to claim 3, wherein each of the inner and outer shift limiting elements extends below the bottom wall of the bin a substantially equal distance such that, when the bin is placed on a planar supporting surface, each of the inner and outer shift elements engage the planar surface.

8. The combination tray and bin assembly according to claim 1, wherein the base of each of the cavities is inversely conical and each of the side wall portions of the cavities slope upwardly and outwardly from the base to a respective said common upper edge.

9. The combination tray and bin assembly according to claim 1, further comprising passages formed in the side wall portions of the cavities to fluidly interconnect adjacent ones of the cavities.

10. The combination tray and bin assembly according to claim 9, wherein the passages are generally V-shaped.

11. The combination tray and bin assembly according to claim 10, further comprising dam members formed between adjacent ones of the cavities, within a respective one of the passages.

12. The combination tray and bin assembly according to claim 1, further comprising a plurality of tray seating units projecting downward below the side rim members wherein, when the tray is placed atop an identically constructed tray, the tray seating units are adapted to rest upon the upper ledge of the identically constructed tray.

13. The combination tray and bin assembly according to claim 12, wherein each of the tray seating units includes a shift limiting element and an abutment member, wherein the abutment member is adapted to rest upon the upper ledge of the identically constructed tray and the shift limiting element extends along one of the side rim members of the identically constructed tray.

14. The combination tray and bin assembly according to claim 13, wherein each of the tray seating units includes inner and outer shift limiting elements which are adapted to extend along the side rim members of the identically constructed tray, and wherein the abutment member extends between and interconnects the inner and outer shift limiting elements.

15. The combination tray and bin assembly according to claim 12, wherein the tray seating units have lowermost portions terminating in a plane in which lowermost surfaces of the cavities are located such that, when the tray is placed on a generally horizontal supporting surface, the tray is supported by both the lowermost portions of the seating units and the lowermost surfaces of the cavities.

16. An ice cube forming tray comprising:

an annular outer rim portion defined by integrally formed first and second opposing side rim members and an upper ledge;

a matrix of ice cube defining cavities arranged within confines of the annular outer rim portion, each of the cavities including a base from which project upwardly extending side wall portions with adjacent ones of the side wall portions having a common upper edge that is arranged in a plane below the upper ledge of the annular outer rim portion; and a plurality of tray seating units projecting downward below the side rim members wherein, when the tray is placed atop an identically constructed tray, the tray seating units are adapted to rest upon the upper ledge of the identically constructed tray, each of the tray seating units including a shift limiting element and an abutment member, wherein the abutment member is adapted to rest upon the upper ledge of the identically constructed tray and the shift limiting element extends along one of the side rim members of the identically constructed tray to limit relative shifting between the trays in multiple directions.

17. The ice cube forming tray according to claim 16, wherein each of the tray seating units includes inner and outer shift limiting elements which are adapted to extend along the side rim members of the identically constructed tray.

18. The ice cube forming tray according to claim 17, wherein the abutment member extends between and interconnects the inner and outer shift limiting elements.

19. The ice cube forming tray according to claim 16, wherein the tray seating units have lowermost portions terminating in a plane in which lowermost surfaces of the cavities are located such that, when the tray is placed on a generally horizontal supporting surface, the tray is supported by both the lowermost portions of the seating units and the lowermost surfaces of the cavities.

* * * * *